United States Patent [19]

Lahr

[11] Patent Number: 4,797,016

[45] Date of Patent: Jan. 10, 1989

[54] RIBBON INDICIA SYSTEM

[75] Inventor: Roy J. Lahr, Los Angeles, Calif.

[73] Assignee: Creative Associates, Los Angeles, Calif.

[21] Appl. No.: 18,802

[22] Filed: Feb. 20, 1987

Related U.S. Application Data

[63] Continuation of Ser. No. 797,180, Nov. 8, 1985, abandoned, which is a continuation of Ser. No. 570,734, Jan. 16, 1989, abandoned.

[51] Int. Cl.[4] ..... B41J 31/00

[52] U.S. Cl. ..... 400/237; 400/225

[58] Field of Search ..... 400/237, 238, 239, 240, 400/240.3, 240.4; 400/247, 225; 601/336

[56] References Cited

U.S. PATENT DOCUMENTS 4,496,955 1/1985 Maeyama et al. ..... 400/239

4,551,729 11/1985 Kubo et al. ..... 400/240.3

FOREIGN PATENT DOCUMENTS 217252 1/1942 Switzerland ..... 400/237

*Primary Examiner*—David A. Wiecking

*Attorney, Agent, or Firm*—Kenyon & Kenyon

[57] ABSTRACT

A web, such as a ribbon in a printer, is provided with bar code markings arranged thereon to provide selected information, such as ribbon footage used and ribbon type. A printing fluid applied to the ribbon may be provided with particles having magnetic properties which are readable by a magnetic static read head wherein the presence of the magnetic printing fluid in the vicinity of magnetic gaps in such a head completes magnetic circuitry. Also, such printing fluid may be provided with fluorescent pigmentation, thereby affording optical sensing. In a printer embodiment, a mechanism is shown for synchronizing the output signals of the bar code sensors with a distance measuring device.

4 Claims, 6 Drawing Sheets

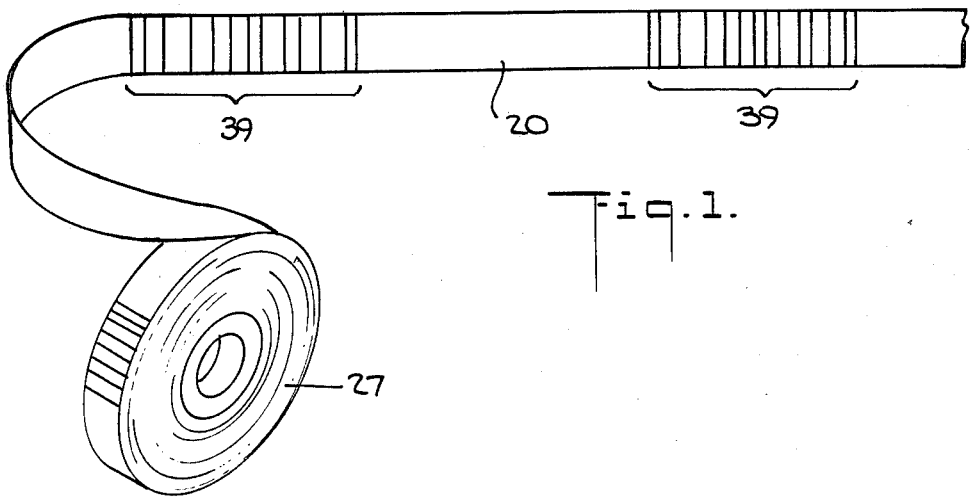
Fig. 1.
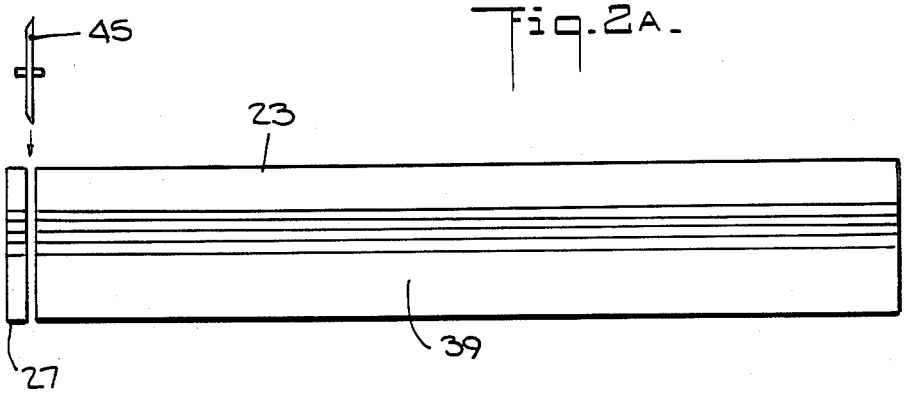
Fig. 2A.
Fig. 2B.
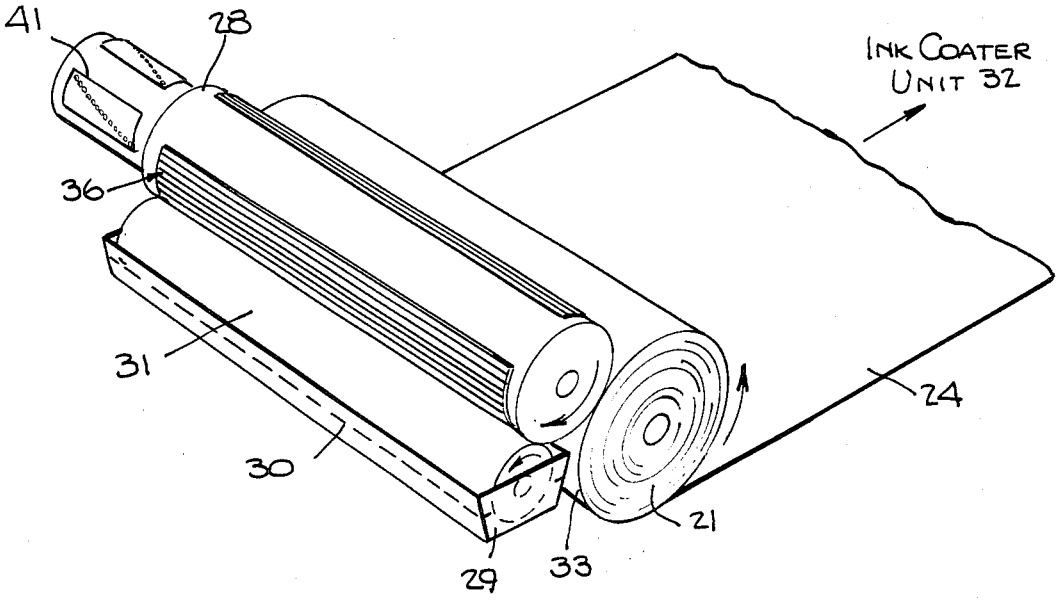

RIBBON INDICIA SYSTEM

This application is a continuation, of application Ser. No. 797,180, filed Nov. 8, 1985, now abandoned, which is a continuation of Ser. No. 707,34 filed Jan. 16, 1984, now abandoned.

BACKGROUND OF THE INVENTION

This invention relates generally to typewriters and printers which utilize multicharacter, fully-formed print elements or which form characters by a matrix of dots, and more particularly to a printer arrangement wherein a mark is formed by causing ink to depart from a layer on a ribbon and depositing upon a receiving surface.

It is well known that business employs a variety of printers and typewriters to produce easily-readable information on paper. This information can be in the form of text, graphs, diagrams, or even pictures. In many offices, such printed output is then transported to a photocopier wherein copies are made for distribution, rather than making several copies on the printers that produced the original information sheet. It is also well known that the act of photocopying often reduces the quality of the information, when compared with the original image, so that it is important for the office operator of the typewriter or printer to produce the very best original image of the information that is possible.

Once the equipment used for printing originals has been carefully adjusted, either for thermal or impact printing action, much of the remaining quality is determined by the choices of ribbon and output paper. The ribbon is generally either a film of ink coated on a thin plastic layer, or an investment of ink dispersed in a fabric ribbon which is typically thicker than the thin plastic layer. The film ribbon can be used with either thermal or impact printing system, by appropriate selection of the plastic film and the ink formulation. The fabric ribbon, however, is used only with impact printing systems of the type using either fully-formed characters or a dot matrix character-forming process. The ink color can be black, as by admixture of carbon particles, or any of several other colors produced by dyestuff mixture.

While the majority of applications require black or colored ink for producing originals which have their utility in providing readable information, some office or business printers produce special printed materials that will be scanned for information by machines. For example, when negotiable instruments such as checks are to be read by high speed sorting equipment, they are generally imprinted using a dark ink with special magnetic properties. The characters used can be read by humans and machines to yield information relating usually to numeric values of the transaction, account numbers, issuing bank number, and other internal transfer information. These check imprint characters are, in the United States, approved by the American Banking Association and called Magnetic Ink Character Recognition or MICR. While it is most common for a bulk printing operation to encode checks with the basic MICR information, it is not uncommon to provide manually-operated printers and typewriters to make up special checks, or to provide bank customers with temporary supplies of MICR-encoded documents until the printer can supply a larger quantity.

Colored inks have been used for highlighting the darker text characters, with red being the most commonly used highlighting color. Some printing equipment may use two separate ribbons, one of a dark color, such as black, and the other red. Other equipment may use either two separate ribbons, or an easily replaceable cartridge with such cartridges supplied with ribbon in any of several colors, including black. Some known ribbons for typewriters or adding machine are made of fabric with a top band of black ink and a lower band of red ink; the desired ink color being selected by vertical positioning of the ribbon at the printing zone of the printer or typewriter. A few printers use sections of ribbons which bear different color inks, for example, the largest center section having black ink, add end sections having red, yellow, blue, and green inks available. These multisection ribbons use longitudinal positioning to select either basic text color or a highlighting color, as desired, with incremental stepping to position an unused portion of ribbon for character formation within the desired color section.

It is also well known that ribbons may be produced which can have either single or multiple use characteristics. Film ribbons can be produced which release all of their ink layer upon one impact, called "full-release ribbons." This type of film ribbon is preferred when the maximum quality imprint is required. Other film ribbons have, in effect, a multilayer characteristic, in which several impacts in substantially the same area can each yield a good quality image This multilayer effect allows the ribbon to provide more output images per unit area, but the print quality is not quite as dark and crisp as that of the single layer, full-release film ribbon. Most thermal transfer printers cause deposition of the entire layer of ink from the ribbon when heat is applied, so that these printers employ single use ribbons. Fabric ribbons are considered to be multistrike ribbons, since the ink can migrate from an unused portion of the ribbon to replenish the ink in a region in which character-forming impact has removed some portion of the ink deposited therein during manufacturing. While fabric ribbons can generally deliver more impact images per unit area than can fabric ribbons, the thickness of the fabric layer is several times that of the film layer. Accordingly, the character thus formed will not have as distinct a quality, and often the ink will not be quite as dark as would result by using a high carbon content film ribbon.

There is a demand for a more accurately controlled ribbon transport system as the need for a larger variety of printing tasks to be performed by a single office machine increases. Such a need is intensified as printing equipment speed increases so as to provide more information output from a single machine. The need for better ribbon control is evident at least from the fact that it is now very common to construct a complete document, perhaps only viewing it on an informational display, such as a cathode-ray tube, thus providing review for correction and layout formatting. Once the document is deemed satisfactory, the corrected information is then passed to a printer, with the hope that the printer will perform the indicated task. If the output pages are to have a special quality, such as the very best image darkness and edge sharpness that the particular printer can produce, a single release film ribbon is generally selected.

Inasmuch as ribbons for many printers, are provided in cartridges, and the cartridges for the various printers oftentimes look very much alike, it is important that the correct type of cartridge be installed on the printer. Often, it is left to the operator to be very careful to select the proper ribbon, and it is a problem that there is not in widespread commercial use a machine-readable system for indicating that a mistake in ribbon cartridge selection has occurred. These mistakes in cartridge selection are quite common since a single release ribbon and a multistrike ribbon look entirely similar, and generally only upon reading the model number or looking on either the outer wrapper or the packaging box will the type of ribbon contained therein be indicated. Moreover, when ribbons are used that have several color sections, if the dark portion is in place, it is easy to mistake a colored section ribbon for an all-black ribbon The price of these ribbon mis-selections is at least the time and cost of producing an unusable document, the time lost in replacing the ribbon, and the waste of the used ribbon itself.

In currently available printer systems, when a multicolor ribbon using the longitudinal section color system is used, the present practice is to use a shaft encoder to monitor ribbon positioning. As printer equipment is required to achieve faster printout speeds, it is a further problem that the demands for ribbon positioning at high speeds results in mispositioning caused by slippage between the shaft encoders which intermittently jam when waste particles of ink left over from the impact printing gather in a gear or in a bearing so as to increase drive friction.

There is a developing need in the printer art for printing equipment which is utilized in a remote manner, by the transmission of print commands from an operator's terminal which may be several feet, or very distant, from the printing equipment. It is a problem that a signal is not provided to such a remote operator indicating the ribbon type installed on the printer, or the quantity remaining. Generally, no signal is produced until the end of the ribbon or a required color section has been reached. The present state of the art does, however, provide a remote signalling arrangement which operates to inhibit further printing. Since printer stoppage usually occurs without a warning, the operator may request a printout of a several page document and have no warning of insufficient ribbon to complete a job until a signal such as "ribbon out" is received. This will usually not cause any physical damage, but it will usually spoil the partially-printed page and thereafter a new ribbon must be inserted when someone notices the signal and restarts that page.

Since remote operation is increasingly desired, thereby permitting several operators to create text and documents at their respective work stations and share a relatively expensive printer, it is a problem that no one operator can have knowledge at the work station of the amount of ribbon available for printing. Even if one wished to go to the printer and look, the ascertainment of the remaining amount of ribbon in a printer is a frustrating experience. First, the ribbon box is usually located under a cover, and if the printer is in use by another, the raising the cover will usually stop or spoil the printing of a job in progress. Second, once in view, there may be no opening in the cartridge through which the ribbon reels can be seen. Third, if an opening in the ribbon cartridge has been provided, it is difficult to estimate just how much ribbon remains, and how many documents might be produced, even if only one operator were to demand output documents, rather than have the usual intermix of job orders.

In modern offices, one of the major justifications for computer-based equipment, such as word processing stations, perhaps with remote printers, is both, to facilitate the normal flow of work, and especially to facilitate handling of sudden emergency needs. These emergency jobs are the most critical from a time pressure standpoint, and the unplanned interruption of a "ribbon-out" signal or a document produced in a mixture of colors by mistakenly placing a longitudinal color mix ribbon instead of the desired all-black ribbon, thus producing a completely unusable document, is certain to cause much frustration. It therefore would be preferable from the standpoint of increasing job efficiency if the control terminal were to be provided with information that would indicate if: (1) the correct ribbon was in place, and (2) how much ribbon remains. It is particularly essential to know whether the amount of remaining ribbon is sufficient to complete the intended job. If not, the ribbon could be replaced before the job starts, or a smaller job could be selected out of sequence to use up the last remaining portion of ribbon in the cartridge or spool.

There is also a need for improved manufacturing control while producing ribbons, particularly when the ribbon may have several colors or types of ink emplaced on the one base stock. If the longitudinal section method of color or special ribbon type is to be used, it is very important that the manufacturer be able to communicate to the user which capabilities were emplaced and in which locations. It is a problem that no such machine readable encodement is provided in the art, and thus the desired communication does not occur. Manufacturers may decide to change ribbon length and customers may not notice the change until after a spoiled printout has occurred.

It is, therefore, an object of this invention to provide an indicia marking that will allow machine sensing of ribbon type during the complete use period of that ribbon.

It is a further object of this invention to provide an indicia marking that will allow machine sensing of the amount of ribbon of a particular type that has been used.

It is another object of this invention to produce an indicia marking on the ribbon that will instruct the printer as to the capabilities of the ribbon in the cartridge or spool emplaced therein.

It is also a further object of this invention to provide indicia that will aid manufacturing control of ribbon to ensure that proper ribbon type admixture and intended length occur.

It is a still further object of this invention to provide machine-readable indicia such that remote operators of printers can transmit information about ribbon type and quantity so as to be able to plan job flow without interruption or printing errors.

SUMMARY OF THE INVENTION

The foregoing and other objects are achieved by this invention which provides an indicia marking system for a web, illustratively a ribbon of the type which may be used in a printer. During manufacturing, the web is brought into communication with a roller carrier which has a preselected diameter and is arranged to rotate with the travelling web. The roller carrier is provided with at least one printing member having a printing surface for selectably communicating with the web. An actuation mechanism couples the printing member to the roller carrier and urges the printing member substantially radially with respect to the axis of the rotating roller carrier between radially outer and radially inner positions. When the printing member is in the radially outer position, its printing surface communicates with the web periodically.

In such an embodiment, a reservoir of printing fluid, which may have magnetic and fluorescent signifying characteristics, is deposited on the radially extended printing surface of the printing member so that a corresponding marking is deposited on the web. The amount of printing fluid deposited on the printing surface of the printing member is controlled by a simple mechanism which may include a doctor blade. The resulting bar code marking is relatively long and is deposited prior to slitting of the web into conventional printing ribbon widths.

In a preferred embodiment of the invention, the roller carrier is provided with a plurality of printing members, illustratively in combination with one or more fixed printing members which are not retractable, the combined plurality of printing members corresponding to a code group. Thus, a code is formed by the selective extension and retraction of various one of the printing members. The particular arrangement of retracted and extended printing members is determined by actuation of a programmer which, in one embodiment of the invention, may be arranged in the vicinity of the end face of the roller carrier. Each printing member is connected by a mechanism to a respective actuating element in the programming area of the roller carrier. Additionally, a reset mechanism may be provided on the end face of the roller carrier for resetting all of the printing members selectably to a retracted or an extended position.

In accordance with a further aspect of the invention, the markings on a ribbon in a printer embodiment are read by a novel static read head having a core of ferromagnetic material which forms at least one magnetic circuit. An input coil is wound on a first portion of the core, and an output coil is wound on a second portion of the core The core may be constructed in laminations and is provided with a magnetic gap which serves to interrupt an magnetic circuit. In operation, the input coil is energized with a signal having a predetermined frequency, but any substantial flux in the core cannot be induced as a result of the magnetic interruption represented by the magnetic gap. However, when a code marking having magnetic particles therein is brought to the vicinity of the magnetic gap, a magnetic circuit is completed whereby flux is induced in the core In essence, the effective reluctance of the magnetic circuit is reduced by the presence of the code marking at the gap. Such magnetic flux generates a voltage in the output coil; the output voltage having a duration corresponding to the duration of the presence of the code marking at the gap. Thus, such a read head can determine the static presence of a code marking at the gap, and does not rely upon the velocity of the code marking passing thereby.

In a practicable embodiment of the invention, the distance between the code markings is determined by using a ribbon length monitoring device which communicates with the ribbon as it moves intermittently and assists in the determination of the distance between the code markings. Thus, a code position can be determined for an absent code marking, in accordance with the particular code being used. In one embodiment, each code grouping is initiated by a first code marking which is always present, and therefore corresponds to a marking produced by a fixed printing member on the roller carrier. A phase synchronizing arrangement is provided for synchronizing an output signal of the distance measuring mechanism with the initial code marking. Thus, the system of the present invention can accommodate for ribbon slippage.

In a preferred printer embodiment of the invention, the ribbon indicia marks consist of bar code marking, which, when read by a static read head arranged on the printer near the point of ribbon use causes information to be transferred from the rear, or nonink bearing surface of the ribbon, to an informational store, such an electronic solid state memory. Once stored in the memory, such ribbon information can be compared with expected data to ascertain that the proper ribbon type has been emplaced, and if desired, transferred to another operation-control terminal for use in the management of printer operations. Additionally, the printer may use the footage indicia markings to measure ribbon usage and to control ribbon repositioning when a sectored color ribbon is used for graphmaking or highlighting.

As noted, a bar code marking is preferred as the indicia marking on the rear ribbon surface because such a bar marking can be deposited on the entire stock ribbon roll before or during ink coating manufacturing operations. Accordingly, when the ribbon stock roll, or web, is slit into the individual ribbon reels, each such reel will have a section of such bar markings. Stock roll marking is thus an inexpensive addition to ribbon manufacturing operations, and can be used also as a check or control marking to cause automatic interchange of ribbon ink colors or special ink deposition. The bar codes can be used as absolute footage markers, since there is no slippage as with friction-operated footage counters which are the usual method of counting ribbon passage during manufacture.

It is optional with the manufacturer of ribbons whether the bar coding at each footage mark shall contain the ribbon type code, or whether such additional information codes shall be deposited at a predetermined multiple of the basic footage marking. Additionally, -general ribbon information may be encoded at the beginning, or leader end, of the ribbon. Such general information can include ribbon type, special ribbon character such as single or multiple strike so as to facilitate setting of the ribbon advance mechanism on the printer, and whether the ribbon is of the film or fabric type so as to reset the hammer intensity range so that the impact energy is appropriate.

The ribbon footage count indicia markings can be used with a standard shaft encoder which produces a distance measurement signal corresponding to the rotation of a hub around which the ribbon passes. As hereinbefore mentioned, it is a problem in the present state of the art that such shaft rotation monitors are subject to error as a result of ribbon slippage over the hub or jamming caused by ribbon particle accumulation. However, since the reading of the ribbon indicia marking gives a very positive recalibration very frequently, the composite information of shaft rotation and ribbon markings yields a finely divided ribbon usage count of very satisfactory precision. Additionally, if the shaft counter periodically jams as a result of ribbon particle accumulation, the sharp difference between inferred footage count between the shaft encoder data and the ribbon indicia markings can be used to indicate to the cognizant operator that printer servicing, particularly of ribbon path mechanisms, should be requested.

BRIEF DESCRIPTION OF THE DRAWINGS

Comprehension of the invention is facilitated by reading the following detailed description in conjunction with the annexed drawings, in which:

FIG. 1 is an isometric schematic representation of a bar-encoded ribbon and spool;

FIG. 2A is a front view of a bar-encoded ribbon stock roll;

FIG. 2B is a diagrammatic isometric representation of a bar-encoding printing system which is shown to be operating on a ribbon stock;

FIG. 4A is a partially exploded and phantom isometric representation of a bar marker roll showing a marker bar and a programmer input;

FIGS. 4B-1 and 4B-2 are simplified schematic diagrams of the programmer mechanism;

FIGS. 5A-1 and 5A-2 are a fragmented isometric representation of a ribbon shaft encoder and a top view of its phasing harness;

DETAILED DESCRIPTION

Figure 4C:
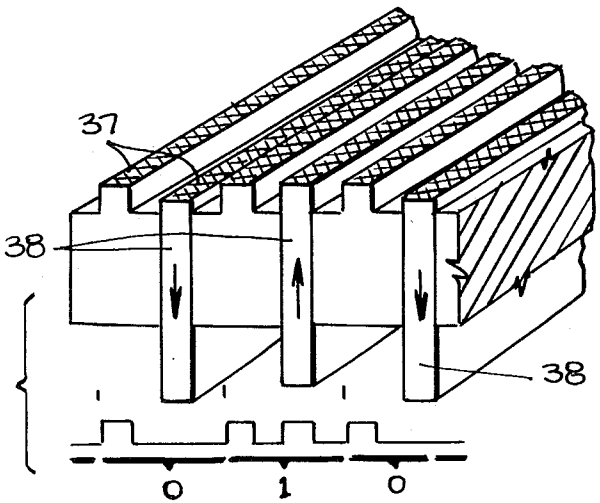
FIG. 4C is a fragmented and schematic isometric representation of the marker bars and code structure.
Figures 1, 2, 4A, 4B:
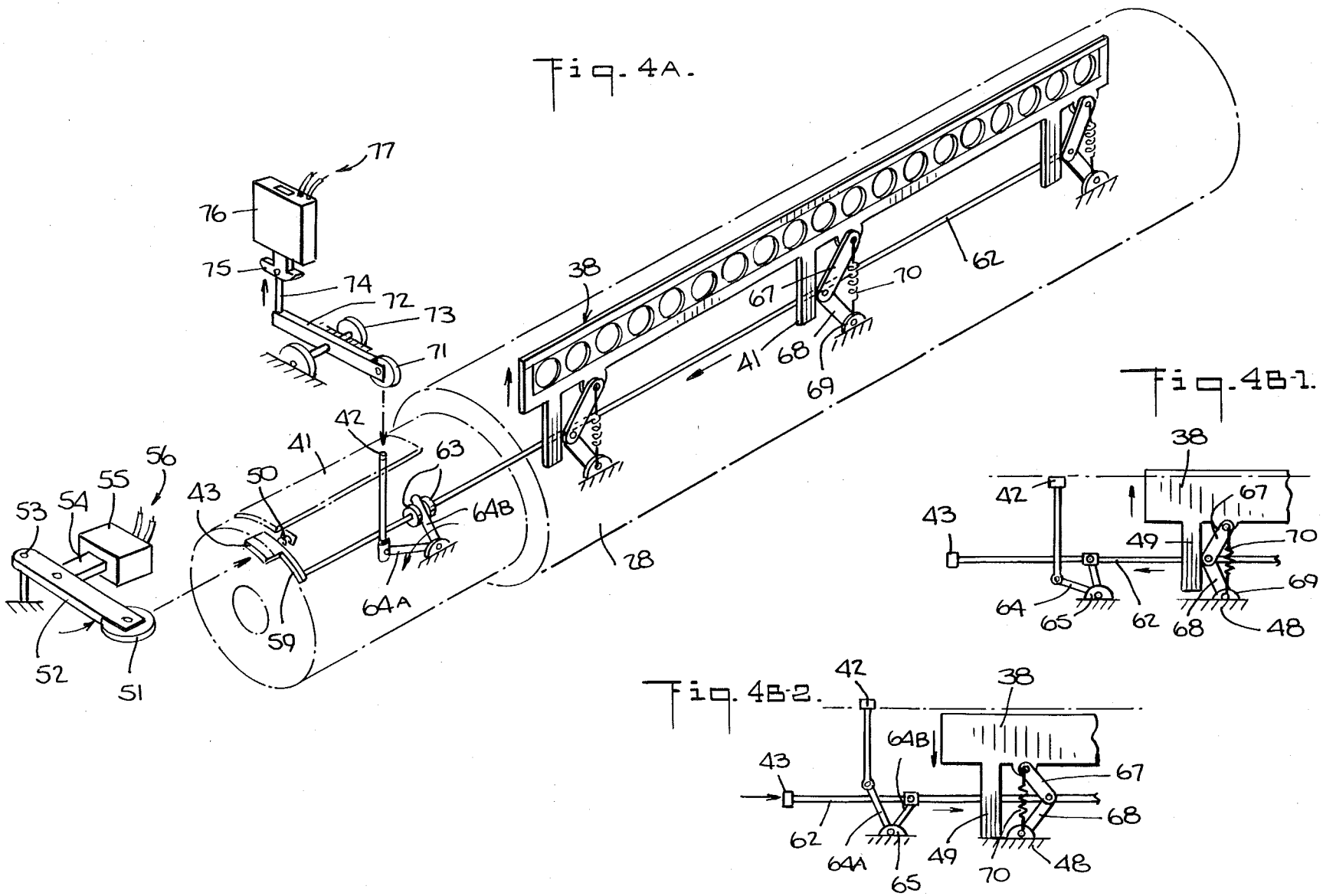

FIG. 1 illustrates a bar-encoded ribbon 20 and a ribbon supply spool 27. A set of marker code groups 39 are arranged periodically orthogonal to the ribbon length, at a distance corresponding illustratively to every 12" therealong.

In FIG. 2A, a bar-coded, ink coated ribbon stock roll 23 is shown in front view. Marker code groups 39 are shown on ribbon stock roll 23 to be imprinted longitudinally parallel with the axis of rotation of the ribbon stock roll. The axis of rotation may have a length from between 36" to 72", depending on the practice of the ribbon manufacturer and the capacity of the ink coater equipment. Bar-encoded, ink coated ribbon stock roll 23 is slit down, illustratively by a disc-shaped slitter knife 45, of a type such as that provided by Dusenbury Corporation, so as to form individual rolls having a width illustratively between 0.5 and 1.0", which are then wound on ribbon supply spools 27.

FIG. 2B is an isometric diagram of a printing system which imprints the bar codes on a raw ribbon stock roll 21. In this embodiment of the invention, a liquid ink 29 having a combination of magnetic particles, such as ferrites of the type which ar commercially available from TDK Corporation, Tokyo, Japan and a fluorescent ink, as produced by DayGlo Corporation, Cleveland, Ohio, is carried in a liquid ink reservoir pan 30. A liquid ink donor roll 31 has its lower surface portion immersed in liquid ink 29. A doctor knife 33, at the rear of liquid ink reservoir pan 30, is set to remove all but a thin film of liquid ink 20 from liquid ink donor roll 31, so that the ink film will coat any raised members of a marker bar code set 36 on the periphery of a marker bar roll 28. If it is desired to coat one marker code group 39 every 12" on raw ribbon stock roll 21, four such marker bar code sets 36 may be placed every 90° on the periphery of a marker bar roll 28 which is constructed to have a 15.28" diameter across the raised members of the marker bars in the diametrically-opposite marker bar code sets 36. Raised members of marker bar code sets 36 are controlled by a marker code programming ensemble 41 on the end of marker bar roll 28.

Figure 3:
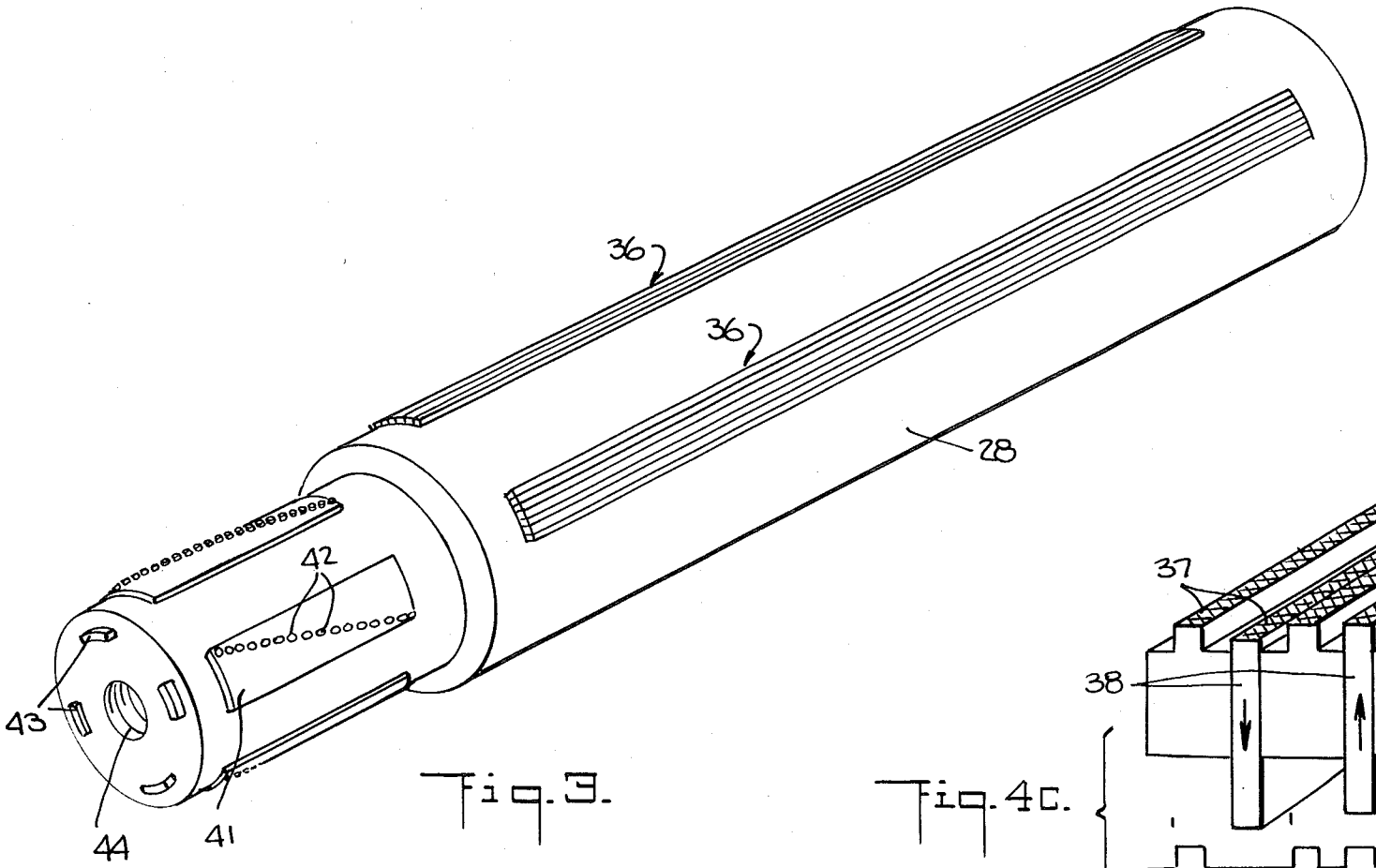
FIG. 3 is an isometric representation of a bar marker roll and marker code programming ensemble.

FIG. 3 is an isometric representation of marker bar roll 28, which rotates on shafts (not shown) which, in operation, are inserted into marker bar roll shaft sockets 44. Individual code bars of marker bar code sets 36 are raised above the surface of the marker bar roll by depressing an individual bar code pin 42 of a marker code programming ensemble 41. Raised code bars of code sets 36 are lowered as a group by depressing a marker bar code group reset 43, after printing is completed by the rotation of marker bar roll 28 against raw ribbon stock roll 21. Of course, the program and reset mechanisms herein can be configured to utilize a reverse logic where individual bar code pins lower the respective code bars; a reset condition causing all code bars to be raised.

FIG. 4A is an isometric representation, shown partially in phantom, of an illustrative marker bar roll 28, illustrating the operating details of a radially movable code bar 38. The radially outermost edge of each such code bar is textured to receive ink and deliver it to the surface of raw ribbon stock roll 21, which may be a plastic film or a woven fabric, and which is usually wound on a cardboard or segmented-plastic core. Movable code bar 38 is coupled to the marker bar roll 28 by an upper bar arm 67 which is pivotally connected to the base of code bar 38, and a lower bar arm 68, which is in turn connected to marker bar roll 28 frame by a bar arm pivot 69. A bar arm spring 70 draws code bar 38 radially inwardly as permitted by the position of the two bar arms.

A bar operator rod 62 is connected to the center pivot between upper bar arm 67 and lower bar arm 68. When a pair of code pin solenoid connector wires 77 are energized, the magnetic field of a code pin solenoid body 76 draws a code pin solenoid core 75 upward within code pin solenoid body 76. This upward motion is transferred to the end of a code pin pivot arm 72 by a code pin arm link 74. As code pin pivot arm 72 swings around a center code pin arm pivot 73, bar code pin pressure wheel 71 swings downward and contacts the top of an individual bar code pin 42. Individual bar code pin 42 is pivoted to an operator rod pivot lever 64A. The downward movement on pivot lever 64A around a lever frame pivot 65 causes leftward motion of operator rod pivot lever 64B which presses leftward on bar operator rod 62 through a set of operator rod flanges 63.

In FIG. 4B, upper diagram, the leftward motion of operator rod 62 is shown as a result of depression of individual bar code pin 42. The leftward motion is transferred to all center pivots of the upper and lower bar arms, bringing these arms leftward against a raiseable bar lower extension 49. When upper and lower bar arms are against this extension, raiseable code bar 38 is locked in an upper position against any pressures during printing. As this bar is raised when under no pressure, reduced forces on operator rod 62 may be used.

Returning to FIG. 4A, when a pair of reset solenoid wires 56 is energized, a strong magnetic field is generated in a reset solenoid body 55, drawing reset solenoid moving core 54 within reset solenoid body 55. Since core 54 is pivotally connected to a group reset swing arm 52 outboard of a group reset swing arm pivot 53, core movement inwards results in rightward movement of a group contact wheel 51. As code marker roll 28 rotates after the reset solenoid is energized, group reset contact wheel will exert rightward pressure on marker bar code group reset 43. Through a group reset extension bar 59, all operator rods of that marker bar code set 36, including raised bar operator rod 62 are pressed leftward along the axis of marker bar roll 28.

In FIG. 4B, lower diagram, the leftward action of marker bar code group reset 43 is shown. Bar operator rod 62 moves leftward, forcing the pivot center connection of upper bar arm 67 and lower bar arm 68 to the left. Once over center, bar arm spring 70 will force code bar 38 downward until raiseable bar lower extension 49 rests against a marker bar roll frame.

FIG. 4C is an isometric end view of a portion of the marker bar code set 36. The code groups for a zero code using one bar, and two bars for a one code are shown in the binary code diagram at the bottom of FIG. 4C. The code bars and code bar spacings are of substantially equal width in this embodiment of the invention, and if a group of fifteen code positions, for example, are to be written, illustratively in a 3" group every 12", each code position will take a spacing of approximately 0.200", and thus a bar, or space, is approximately 0.050" wide. This code affords the advantage that the leading bar of each group may be fixed in an outwardly extended position, such as fixed code bar 37, which also serves as spacer and support for raiseable code bar 38. Since each raiseable code bar 38 may be 0.050" wide by 36 to 72" long, the provision of lateral support thereto is prudent, and the lightweight construction shown in FIG. 4A is preferable. The use of one fixed bar for each "0" or 1" code group also keeps the number of required programmable raising members to a minimum. With fifteen code positions available, in this embodiment, ribbon type codes and a footage count up to 4,096', a length of ribbon which would constitute a very large ribbon supply, is made possible.

In use, the individual code pins of a marker code programming ensemble 41 are preset by bar code pin pressure wheels 71 just prior to the printing operation, and are reset after printing by end pressure through group reset contact wheel 51. Thus, an off-board programming device can provide the proper code formation commands to the marker bars through selective energization of reset solenoid 55 and code pin solenoids 76. One such code pin solenoid is provided for each individual bar code pin 42, to provide a total of fifteen such solenoids in the specific illustrative embodiment described herein.

Figures 2, 5A:
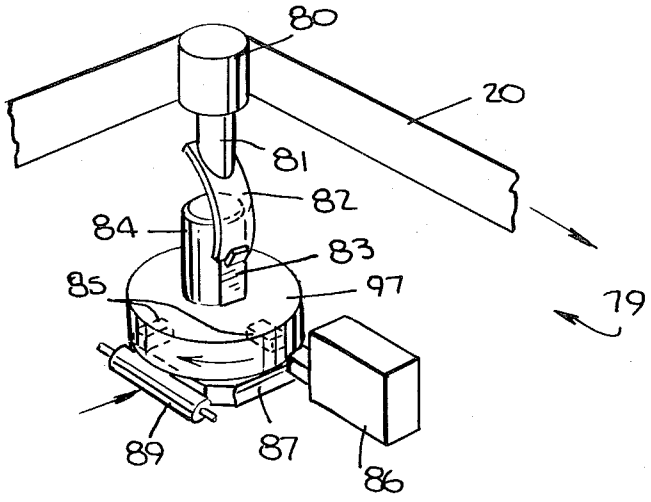

FIG. 5A is an isometric representation and a bottom view of an embodiment of a shaft encoder ensemble 79. This shaft encoder measures relative movement of ribbon 20 by coupling the translation of ribbon 20 around a ribbon roller 80. Rotation of ribbon roller 80 rotates a ribbon roller shaft 81, which fits within a round rotor shaft socket 84. Rotation of ribbon roller shaft 81 is transferred to a rotor 97 by a ribbon roller shaft gripper plate 82, which functions as a resilient friction clip. Gripper plate 82 is constructed of nonrusting spring stock, such as 0.005" phosphor-bronze. The gripping action on 0.250" diameter steel ribbon roller shaft 81 is strong, but has a breakaway torque which has a value lower than the value of the stretch torque of ribbon 20. When this gripper plate is held to rotor 97 by a rotor shaft clip 83, rotor 97 will rotate with ribbon roller 80 rotation up to that breakaway torque level. Rotation of rotor 97 causes a set of embedded rotor magnets 85 to pass near a Hall sensor 86, each such passage causing an output pulse to be produced by the Hall sensor which lasts as long as the magnet is in the proximity of the Hall probe. The duration of the pulse depends upon the length of the ribbon advance steps being used.

Any such ribbon passage shaft counter is dependent for its accuracy on nonslippage of ribbon 20 on ribbon roller 80. Any oily spot on ribbon 20 or very rapid advance of ribbon 20 may cause a slight slippage. Since ribbon 20 has been bar-coded, as shown in FIG. 1, such bar codes may be detected by irradiating the fluorescent ink with near ultraviolet light, or sensing the magnetizable particles therein. By reading selected bars of this code, correct phasing of the shaft encoder rotor is made possible. In this embodiment of the invention, rotor phasing is achieved by driving a rotor phasing bar 89 against a rotor phasing base 87, thereby causing a readjustment of the position of rotor 97. Ribbon roller shaft 81 need not be turned if the phasing action is sufficiently swift that ribbon roller shaft gripper plate 82 slips on ribbon roller shaft 81, after which magnets 85 in rotor 97 are synchronized in position such that the output pulses of Hall sensor 86 are synchronized with the leading pulses of the code sensor, not shown herein.

The specific phasing action is achieved by mechanism shown in the leftmost portion of FIG. 5A, which shows a view of the bottom side of rotor 97, looking upward towards ribbon roller 80. Rotor phasing bar 89 is held in a phasing bar frame 90, which is in turn connected to a frame base 92 by a set of pivotally coupled pantograph arms 91. When a set of two phasing solenoid connecting wires 96 are energized at the moment the lead pulse of a code group is detected, the large magnetic field in a phasing solenoid body 94 pushes a phasing solenoid core 93 upwards against the pull of a phasing solenoid spring 95. This upwards motion drives phasing bar frame 90 upwards, bringing rotor phasing bar 89 into sudden contact with a rotor phasing base flat 88. If the rotor phasing base flat 88 is not completely parallel with rotor phasing bar 89, the sudden pressure will rotate rotor 97 until the phasing base flat and the bar become parallel to one another through intimate contact. Since the energization is only pulsed, rotor phasing bar 89 quickly withdraws under action of phasing solenoid spring 95 after the energization of phasing solenoid 94 is discontinued.

Figures 1, 5A:
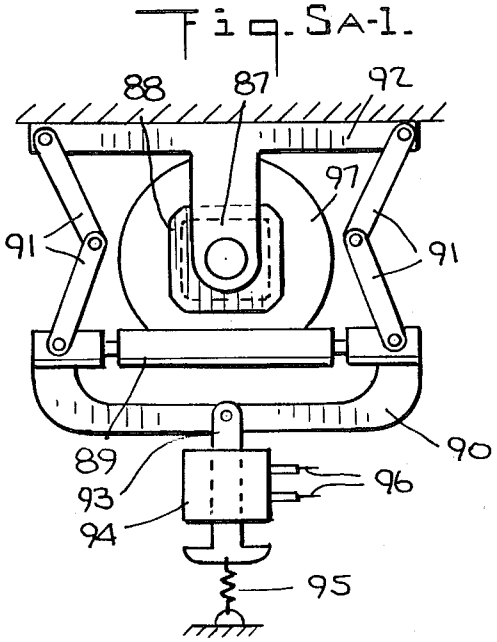
Figure 5B:
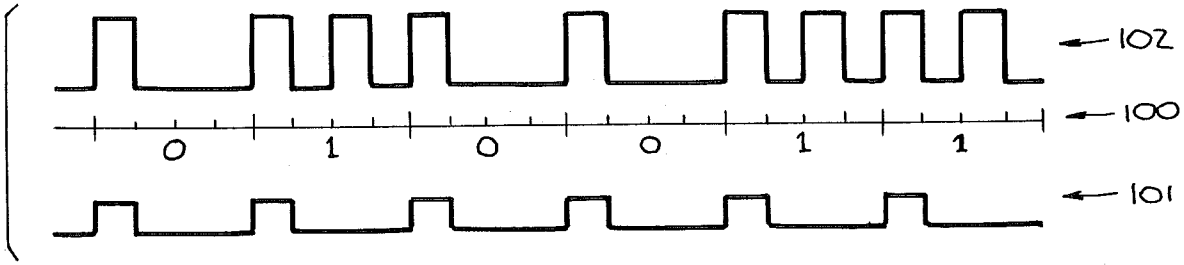
FIG. 5B is a waveform timing diagram of the code bar sensor and shaft encoder outputs.

FIG. 5B shows a timing diagram having a center code position timing line 100 used as a reference line. Hall sensor output 101 is shown below timing line 100, representing a series of pulses corresponding to the passage of ribbon 20; each pulse marking the passage of a code position in the vicinity of the Hall sensor. The code sensor reading the bar code produces a code sensor output 102 shown above timing line 100, with a decoding of the respective code group into "0" or "1" being shown just below timing line 100.

Figure 6A:
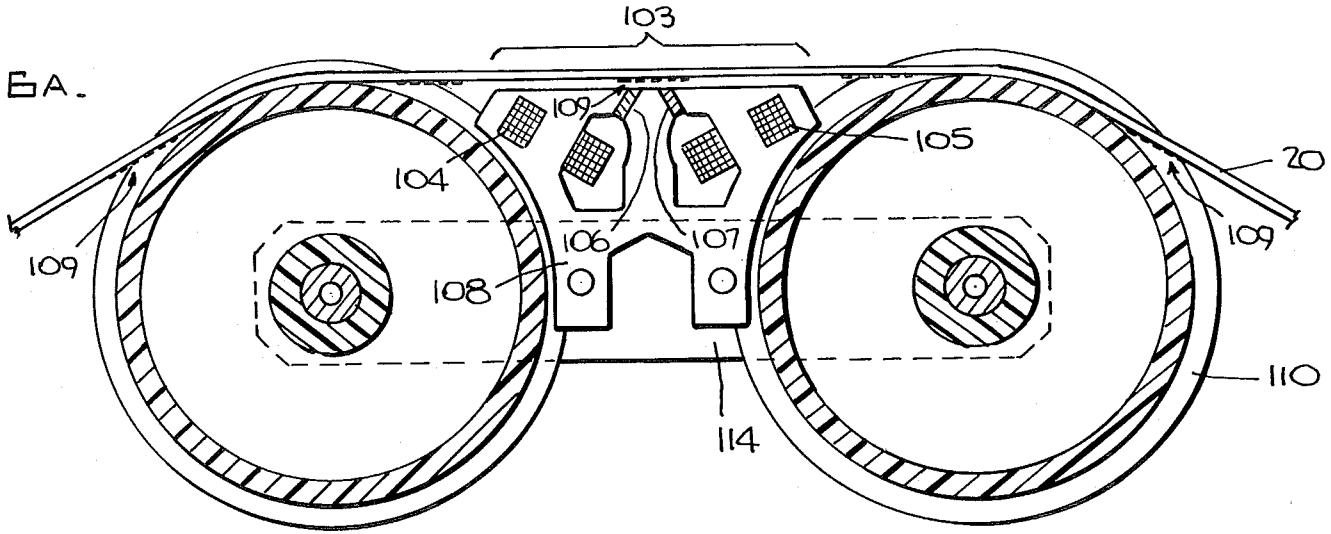
FIG. 6A is a cross-sectional top view of a dancer-mounted bar code sensor.

FIG. 6A is a partially fragmented top view of a specific illustrative embodiment of a code sensor 103 and a pair of dancer ribbon rollers 110 forming a special function ribbon dancer. The usual functions of known dancer rollers are to sense ribbon tension and to control ribbon takeup responsively. In this specific embodiment of the invention, the code sensor uses two dancer ribbon rollers, and thus ribbon 20 is held securely adjacent to stationary code sensor 103 without substantial contact therewith. This allows stable detection of the code bars printed on ribbon 20, as described hereinbefore and shown in FIG. 1. Since FIG. 6A shows ribbon 20 in an edge view, the magnetizable particles within the printed code bars are shown in this figure as a set of ribbon marks 109. As will be further described hereinbelow with respect to FIG. 7, when these ribbon marks 109 pass code sensor 103, the effect of the magnetizable particles included in the ink mixture is sensed.

In operation, a sensor input coil 104 is energized with a voltage having frequency $F_1$. Since a sensor core 108 has a sensor input gap 106 in the core's magnetic path caused by sensor input coil 104, the net path reluctance has a first magnitude when ribbon mark 109 is present, and a second value when it is not. Such differences in the value of the net path reluctance result from the inclusion of the magnetizable particles in the printing ink which is used to make ribbon marks 109. The specific result of energization of sensor input coil 104 and the passage of ribbon 20 bringing ribbon marks 109 past the code sensor is described in detail hereinbelow.

Figure 6B:
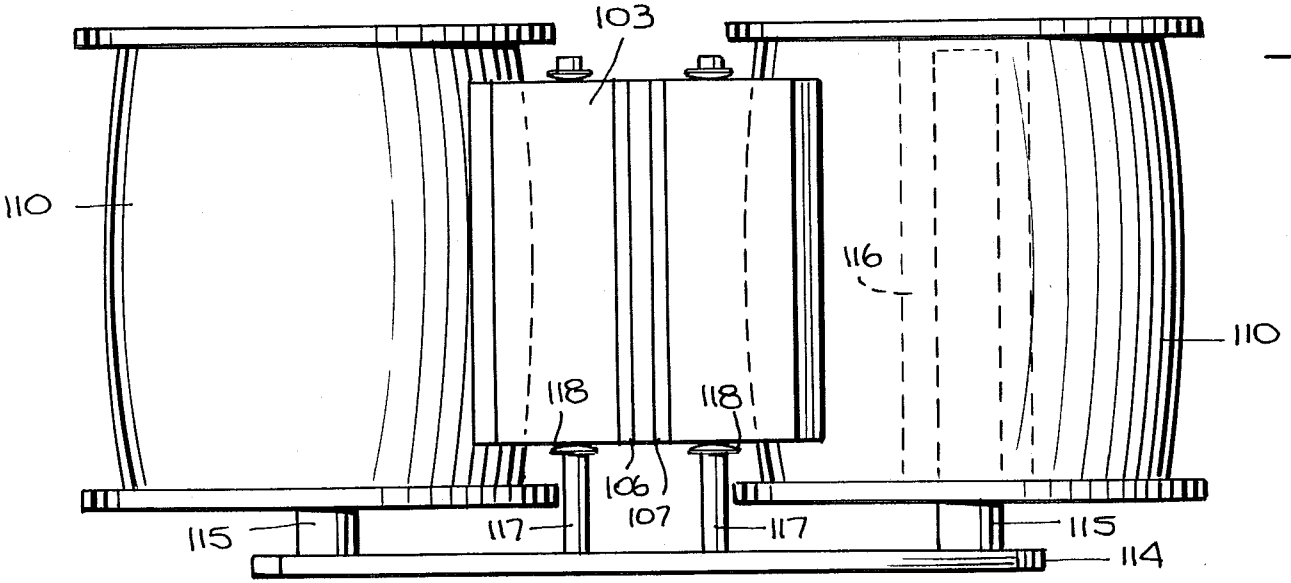
FIG. 6B is a front view of the dancer-mounted bar code sensor of FIG. 6A.

FIG. 6B shows a front view of the dancer-mounted code sensor 103 and the dancer ribbon rollers 110. For the sake of clarity, the code sensor and the dancer ribbon rollers are shown after removing ribbon 20. Input sensor gap 106 and output sensor gap 107 are clearly visible in this view as vertical stripes. To prevent debris from filling these sensor gaps, it is usual practice to prefill the gaps with a nonmagnetic substance, such as brass shim stock. Dancer ribbon rollers 110 are preferentially made of a low friction, durable plastic material, such as DuPont Delrin, and have a formed ribbon roller shaft socket 116 so as to receive the dancer roller shaft 115 atop dancer frame base 114 Code sensor 103 is provided with holes in its sensor core 108 for receiving a pair of sensor mount posts 117 fixed on dancer frame base 114. The vertical position of code sensor 103 is adjusted so as to be centered on the vertical height of ribbon 20 atop dancer ribbon rollers 110. The vertical position thus selected is maintained by affixing a set of four sensor mount clips 118 (only two of which are shown in FIG. 6B) on sensor mount posts 117. Since dancer ribbon rollers 110 each have a slight crown, or bulging shape, the tension present in ribbon 20 keeps the ribbon substantially centered on the dancer ribbon rollers.

Figure 7A:
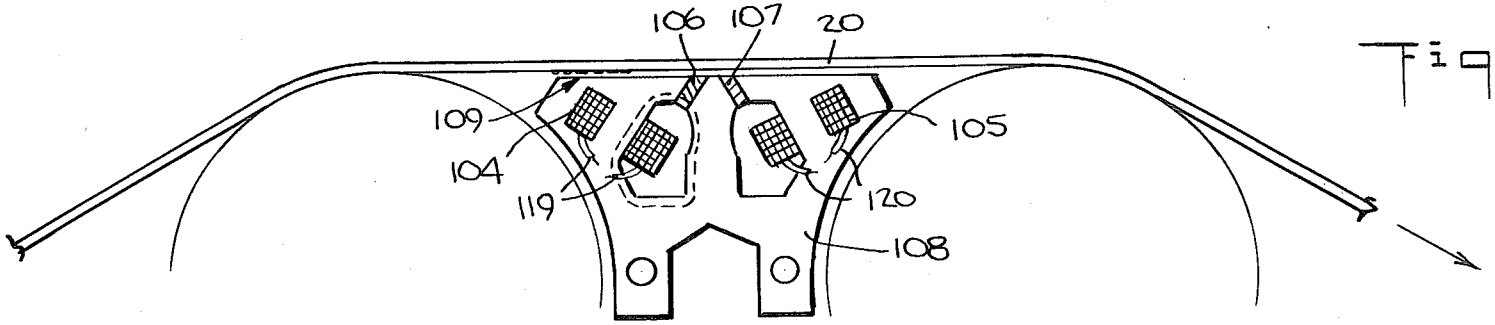
FIGS. 7A, 7B, and 7C are top views of the encoded ribbon passing the vicinity of the sensor and illustrating respective modes of the magnetic fields that result within the sensor in response to the ribbon.
Figure 7B:
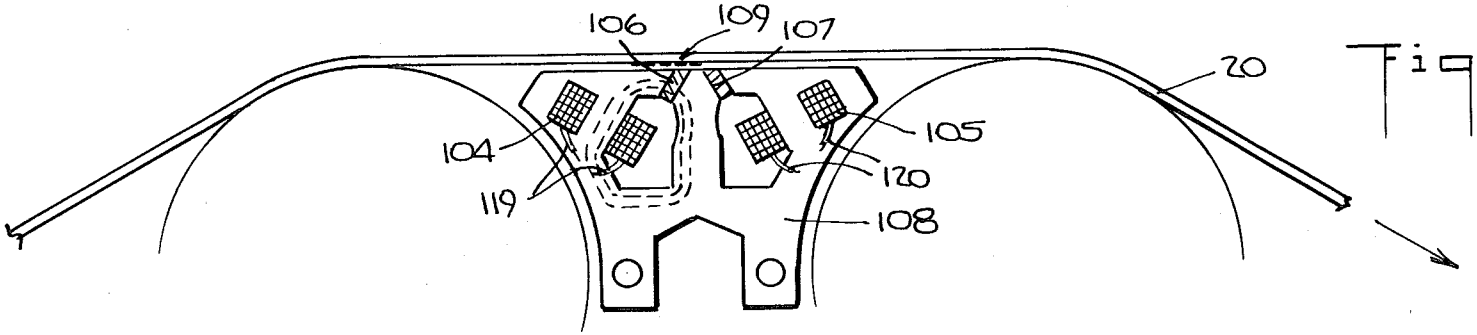
Figure 7C:
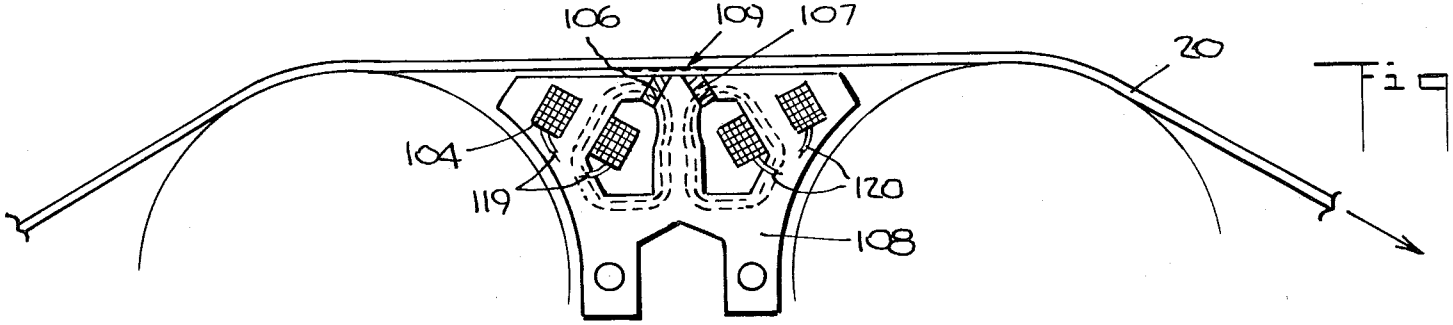

FIGS. 7A, 7B, and 7C are partially cross-sectional top views of code sensor 103, dancer ribbon rollers 110, and ribbon 20, similar to the view of FIG. 6A. In FIG. 7A, a pair of input sensor coil wires 119 are connected to an alternating voltage source, such as an oscillator operating at a frequency $F_1$. Since, in this figure, ribbon mark 109 containing magnetizable particles is not yet adjacent to sensor input gap 106, the reluctance of the sensor core 108 path is relatively large, and only a weak magnetic field is generated. This weak magnetic field is represented by a single dashed line in the leftmost core section. If an analog amplifier were to be connected to sensor output coil 105 at its sensor output coil wires 120, there would be little or no observed voltage, especially as sensor input coil 104 and sensor output coil 105 may be easily shielded against direct magnetic field coupling by a thin wrap of known magnetic shielding, or permalloy tape.

In FIG. 7B, the ribbon 20 has advanced rightward, bringing ribbon mark 109 across sensor input gap 104. This reduces the reluctance of the magnetic path in sensor core 108, and the internal magnetic field is now represented as being stronger in this figure by two dashed lines therein. There is therefore produced at least some coupling between sensor input gap 106 and sensor output gap 107. In this situation depicted in FIG. 7B, a weak field interaction induces some small magnetic field flow in the output portion of sensor core 108, which magnetic field couples with sensor output coil 105, so that a small output voltage will be provided at sensor output coil wires 120.

In FIG. 7C, continued rightward motion of ribbon 20 brings ribbon mark 109 across both sensor input gap 106 and sensor output gap 107. This not only permits a stronger magnetic field to be produced in the left portion of sensor core 108, as shown hereinbefore in FIG. 7B, but the presence of magnetic particles in ribbon mark 109 cross-couples both gaps. This has the effect of reducing the reluctance otherwise present in sensor output gap 107. This combination effect gives rise to a much stronger secondary field in the output half of sensor core 108, and thus a much larger output voltage is generated in sensor output coil 105 across sensor output coil wires 120. A double gap core of this type is preferable to the usual magnetic recording head system since the ribbon transport motion is intermittent and the usual magnetic recording/playback systems are designed to utilize relatively constant media transport velocities. This sensor system can give accurate static readings, and when coupled with the phased shaft sensor system described hereinbefore and shown in FIG. 5, ribbon usage can be accurately monitored, and ribbon type can be ascertained. Thus, a remote user can have both ribbon type and ribbon use data available in electrical form.

It is to be noted that the dual gap code sensor described herein, which functions as a static read sensor, provides high sensing location precision resulting from the fact that the code bar markings on the ribbon must be aligned adjacent to both gaps before an output signal is produced. However, the present invention includes within its scope a single gap device wherein the input and output coils are on the same series magnetic circuit. Such a single gap embodiment would also utilize electronic threshold-sensing circuitry to produce an output signal.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A print ribbon having a start end and a finish end and a longitudinal length representing ribbon footage therebetween comprising:

a flexible substrate having a first side and a second side;

transferable ink deposited on the first side of said flexible substrate;

a plurality of machine-readable marks deposited on the second side of said substrate distributed over the length of said ribbon from said start end to said finish end, each of said plurality of marks being located at a preselected position along the length of said ribbon at a preselected distance from said start end of said ribbon and being spaced from each adjacent mark at a preselected footage interval along the length of said ribbon;

each of said marks being machine-readable information indicating the distance of each said mark from the start end of said ribbon.

2. A print ribbon according to claim 1 wherein the preselected footage interval between each mark is equal.

3. A print ribbon according to claim 1 wherein each machine readable mark is magnetically readable.

4. A print ribbon according to claim 1 wherein each machine-readable mark is optically readable.

* * * * *